United States Patent [19]

Carroll et al.

[11] 4,295,297

[45] Oct. 20, 1981

[54] REVOLVING SECURITY DOOR

[76] Inventors: Noel Carroll, Poet's La., Sherbrooke, Victoria; William F. Carroll, 5 Garden Ct., Wheelers Hill, Victoria, both of Australia

[21] Appl. No.: 78,491

[22] Filed: Sep. 24, 1979

[30] Foreign Application Priority Data

Oct. 6, 1978 [AU] Australia ..... PD6263
Aug. 2, 1979 [AU] Australia ..... PD9865

[51] Int. Cl.[3] ..... E05D 15/02
[52] U.S. Cl. ..... 49/42; 109/8
[58] Field of Search ..... 49/41, 42, 43, 46; 109/8, 3

[56] References Cited

U.S. PATENT DOCUMENTS 2,341,545 2/1944 Hagenbook ..... 49/42
3,285,209 11/1966 Pace ..... 109/8
4,063,519 12/1977 Pretini ..... 109/8

*Primary Examiner*—Kenneth Downey

[57] ABSTRACT

Security door including a revolving door with a one way bearing continuously preventing rotation of the door in a reverse direction so that persons can only travel from an entry to an exit side of the door by passing around the door axis in a forward direction. A mat switch is positioned so that persons attempting to pass from the exit side to the entry side by revolving the door in the forward direction must stand on the mat switch and operate it. Operation of the mat switch causes operation of a clutch which locks the door against rotation in the forward direction.

3 Claims, 4 Drawing Figures

REVOLVING SECURITY DOOR

BACKGROUND OF THE INVENTION

Field of the Invention

This invention relates to security doors such as those used, for example, for controlling access by persons between different security areas at airports or the like.

BRIEF SUMMARY OF THE INVENTION

According to the present invention there is provided a security door, comprising a structure defining a doorway, and a revolving door positioned to control access through the doorway, the revolving door having a plurality of upright door panels extending from an upright axis and arranged so that persons can pass through the doorway from one end thereof to an opposite end thereof only by walking between two adjacent said panels as the door revolves about said axis; first means being provided permitting revolving of the door only in a first direction and second means being provided for sensing when a person is located for movement, by virtue of rotation of the door in said first direction, from said opposite end of the doorway to said one end thereof, and then precluding revolving of the revolving door in said first direction to lock said door.

BRIEF DESCRIPTION OF THE ACCOMPANYING DRAWINGS

The invention is further described by way of example only with reference to the accompanying drawings in which.

DETAILED DESCRIPTION

Figure 1:
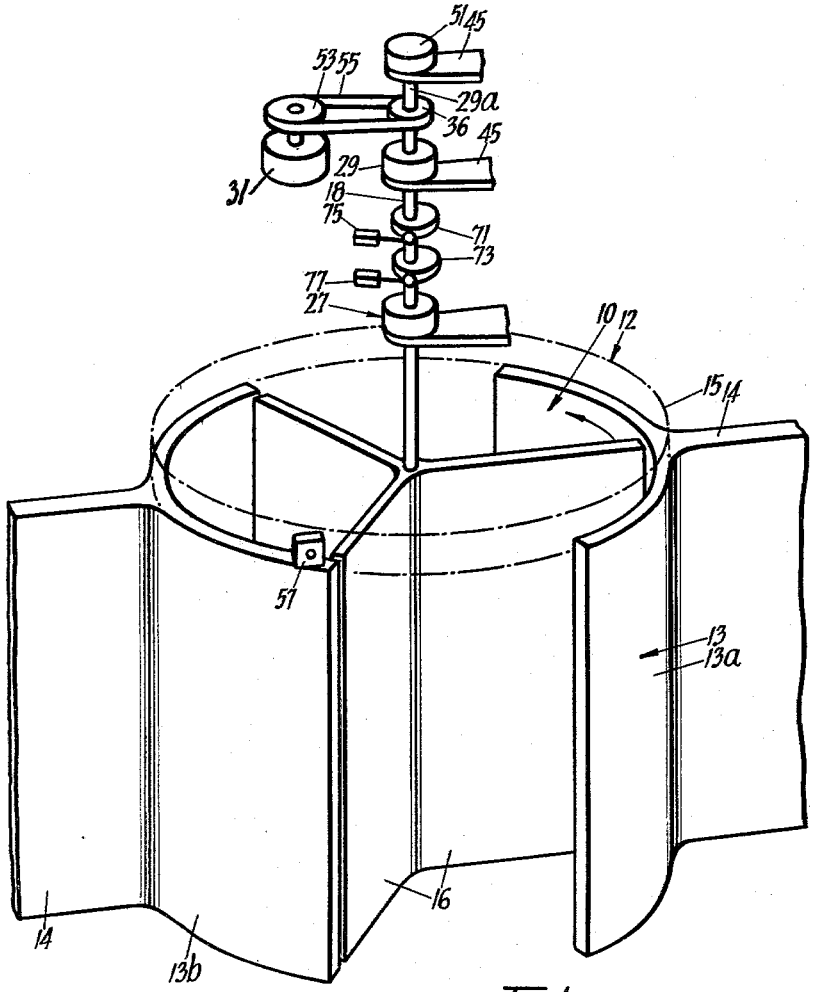
FIG. 1 is a diagrammatic perspective view of a security door constructed in accordance with the invention.

The door 10 shown is arranged for controlling access through a doorway 12 defined in a wall 14. The doorway 12 is defined by a generally cylindrical upright enclosure 13 in wall 14 and having opposed entrance and exit openings 20, 22 respectively. The enclosure 13 has a roof shown only by phantom lines 15 in FIG. 1 for clarity. The door 10 is a revolving door having an upright shaft 18 and three radially extending upright door panels 16 extending from shaft 18 and equiangularly spaced therearound. Shaft 18 is mounted for rotation about its axis so that, with the door 10 rotating, persons can pass from entrance opening 20 to exit opening 22 by stepping through the entrance opening into the space between two panels 16 and walking around the axis of shaft 18. It will be observed that the two opposed portions 13*a*, 13*b* of the enclosure 13 which extend between the entrance and exit openings are of part circular form and extend over slightly more than 90 degrees around the axis of shaft 18. Thus, when door 10 revolves, each adjacent pair of panels 16 will, as they pass a portion 13*a*, 13*b* of the enclosure 13 define with that portion an enclosed space 12*a*, 12*b* as shown.

Figure 2:
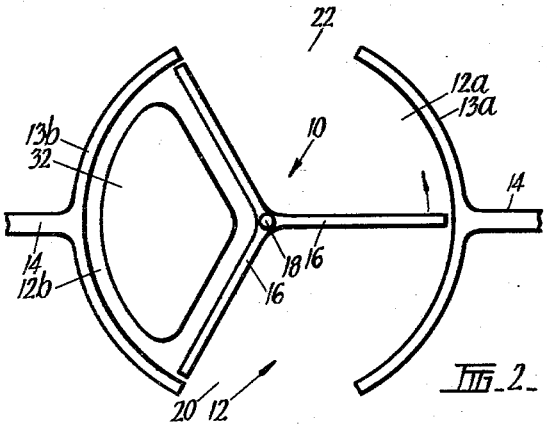
FIG. 2 is a diagrammatic plan view of the door of FIG. 1.
Figure 4:
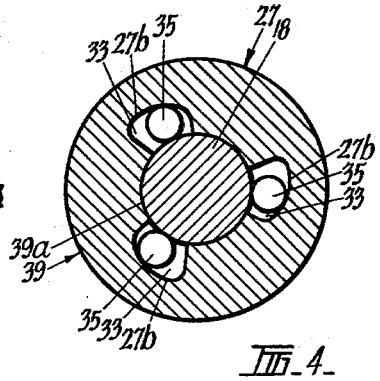
FIG. 4 is a transverse section of a one-way bearing incorporated into the door of FIG. 1.

Door 10 is arraged so that it can be rotated only in the anti-clockwise direction as viewed in FIG. 2. Thus, shaft 18 passes at the upper end thereof through a one way bearing 27. Bearing 27 is of known form having a body 39 with a bore 39*a* therethrough which accommodates shaft 18 and which has formed therein an array of depressions 27*b* which together with the periphery of shaft 18 define a plurality of cavities 33 between the shaft and bearing. These cavities each extend part way around the periphery of the shaft but are of tapered radial dimension. Each accommodates a separate roller bearing element 35 so dimensioned that when the shaft 18 turns in one direction the elements tend to move towards the larger dimensioned ends of the cavities 33 to permit free rotation of the shaft. On rotation in the opposite direction, the elements 35 jam in the smaller dimensioned ends of the cavities and preclude rotation between the shaft and bearing 33. By this means, it is possible for a person to pass from the entrance opening 20 to the exit opening 22 of the doorway defined by enclosure 13 only be rotation of the door 10 in an anti-clockwise direction; that is to say only by passing around the axis of the door such as to pass the portion 13*a* of enclosure 13.

The door 10 is controlled so that a person entering the entrance opening 20 cannot move completely around the enclosure 13 to re-emerge from the entrance opening 20 and so that movement of persons through the doorway 12 in the direction from the exit opening to the entrance opening is precluded. This is effected by means of a mechanism including an electromagnetic clutch 51 attached to the upper end of an input shaft 29*a* of a reduction gear box 29 through which the shaft 18 is, as described later, in use driven. Clutch 51 is operable under control of a mat switch 32 to clutch the shaft 29*a* to a suitable fixed part of the enclosure 13, such part being generally designated by reference numeral 45, so that the shaft 18 is correspondingly locked and the door is brought to a locked condition at which it cannot be rotated. Mat switch 32 is positioned in doorway 12 adjacent enclosure portion 13*b* so that a person attempting to pass from the exit opening 22 to the entrance opening 20 by virtue of revolving of the door 10 must pass over the mat switch 32 and stand on this before reaching the entrance opening 20 so stopping the door and preventing such passage to the entrance opening. It will be observed in this respect that the mat switch is so positioned that when operated, two adjacent panels 16 of the door 10 co-operate with enclosure portion 13*b* to form the aforementioned enclosed space 12*b* so that a person stepping on the mat 32 in this way and attempting to continue movement in the reverse direction around the door axis may be trapped within the enclosed space when clutch 51 operates to lock the door 10. In a similar manner a person attempting to pass completely around the door from the entrance opening 20 to the exit opening 22 towards the entrance opening again must similarly step on mat switch 32 and the door will likewise be stopped to prevent such passage to the entrance opening.

Figure 3:
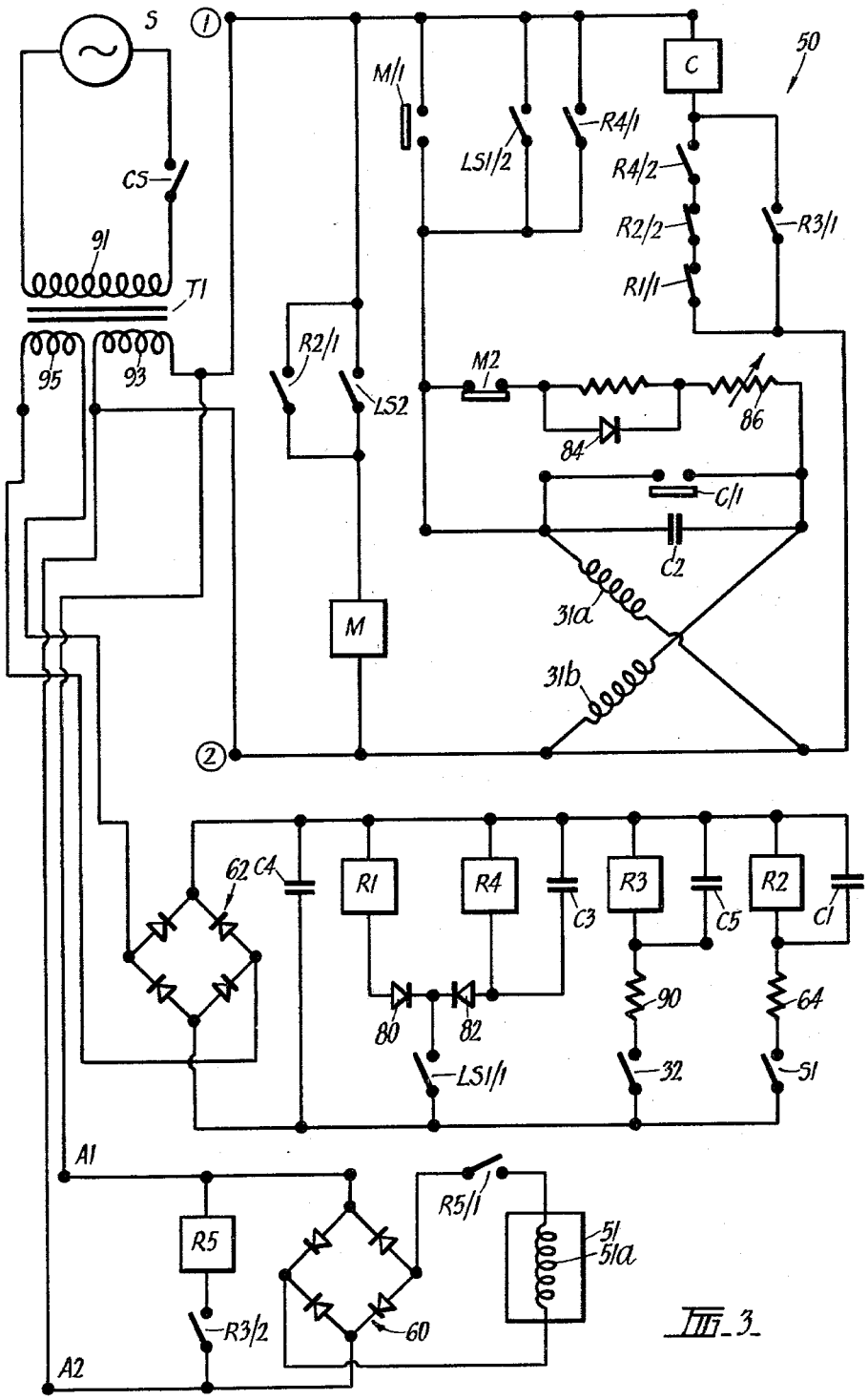
FIG. 3 is a diagram of a control circuit for the door of FIG. 1.

Door 10 is electrically operated by a control circuit 50 as shown in FIG. 3. The circuit controls operation of a motor 31 which drives shaft 18 via reduction drive gear box 29. A pulley 36 is connected to the input shaft 29*a* to gear box 29 and a pulley 53 is connected to the drive shaft of the motor, an endless belt 55 interconnecting the pulleys 53, 36. Normally, operation of the motor 31 is controlled by the circuit of FIG. 3 so that it is operated when a person approaches the entrance opening 20, such approach being detected by any conventional means such as, for example, by a detector 57 of the kind which generates ultrasonic sound or a microwave radio signal and directs this to the area adjacent entrance opening 20 and which is arranged to detect reflections of such sound or radio waves when a person approaches the entrance opening.

The control circuit 50 is powered from an alternating current source (S) connected via a control switch (CS) to the primary winding 91 of a transformer T1. Transformer T1 has a secondary winding 93 providing a 110 volt supply which is applied across the terminals marked 1 and 2 in FIG. 5 for operation of the motor 51.

The aforementioned 110 volt supply from transformer T1 is also applied across a bridge rectifier 60 which provides a supply, under control of the circuit 50 itself to operate the clutch 51.

Transformer T1 also has a second secondary winding 95 which generates a 12 volt supply applied to a bridge rectifier 62 and smoothing capacitor C4 which provides a direct current supply for operating certain relays as hereinafter described.

In the unactuated condition of the circuit, various relays forming part of the circuit have the contacts thereof, as shown in the circuit, in respective open or closed positions as indicated. Under the condition where detector 57 detects presence of a person approaching entrance opening 20, the detector operates to close a switch S1 and this results in application of supply from the rectifier 62 to a relay R2 via a resistor 64 for energization to relay R2. Under such energization, contacts R2/1 of relay R2 are closed and contacts R2/2 of relay R2, which are normally closed, are brought to an open condition. The closing of contacts R2/1 causes application of supply from the 110 volt supply applied across the terminals 1 and 2 to a relay M to energize relay M. Energization of relay M causes closing of relay contacts M/1 and opening of contacts M/2.

Motor 31 is a split-phase induction motor having two windings **31*a*, 31*b*. Winding 31*a* is connected so that, on closing of the aforementioned contacts M/1, this winding 31*a* is energized from the 110 volt supply applied across terminals 1 and 2. Under this condition, the winding 31*b* is likewise energized via a capacitor C2, with out of phase current so that the motor 31 is operated to begin rotation of door 10 in the anticlockwise direction as viewed in FIG. 2. A person approaching the door 10 may thus step through the entrance opening 20 between a pair of panels 16 and begin moving around the door towards the exit opening 22**.

Reverting to FIG. 2 again, it will be seen that there are two cams 71, 73 carried by shaft 18 at the upper end thereof. These are arranged to control operation of respective microswitches 75, 77. Microswitch 75 has a set of contacts LS2 and microswitch 77 has a set of contacts LS1/1 and a set of contacts LS1/2.

When about 15 degrees of rotation of the door 10 has occurred from turning on of motor 31, microswitch 75 is actuated to cause closing of contacts LS2. These contacts are connected across contacts R2/1 and thus serve to hold the relay M energized notwithstanding any subsequent de-energization of relay R2. In this respect relay R2 has a large value capacitor C1 connected thereacross so that even if detector 57 is only actuated for a short time after a person approaches the doorway entrance opening 20, contacts R2/1 will remain on for a long enough period to ensure that an adequate time is permitted for contacts LS2 to close. The capacitor C2 may be, for example, large enough to ensure that relay R2 remains on for some five seconds after opening of switch S1.

After some 30 degrees of rotation have occurred, microswitch 77 is also operated so that contacts LS1/1 and LS1/2 are closed. Operation of contacts LS1/1 causes energization of two further relays R1, R4 from rectifier 62 through respective diodes 80, 82. At this stage then:

(a) relay contacts LS1/2 remain closed and bridge the contacts M/1;

(b) relay contacts R4/1 of relay R4 are brought to the closed condition pursuant to energization of relay R4, to further bridge contacts M/1;

(c) further relay contacts R4/2 of relay R4 are also brought to the closed condition pursuant to energization of relay R4; and (d) normally closed relay contacts R1/1 of relay R1 are opened pursuant to energization of relay R1.

The closing of contacts LS1/2 and R4/1 maintains supply to motor winding **31*a* even in the event of denergization of relay M or of opening of conacts LS2**.

The now closed relay contacts R4/2 and R1/1 are connected in series with the aforementioned relay contacts R2/2 which at this stage may be either open or closed depending upon whether the relay R2 remains energized.

As rotation of door 10 continues, a person passing through the door can reach the position of the exit opening 22 and leave the doorway. Contacts LS2 remain closed until about 270 degrees of rotation of the door have occurred. At this point, however, cam 75 operates contact LS2 to open them. Now, the delay time for maintenance of energization of relay R2 after an opening of switch S1 (as provided by capacitor C1) is such that if no further person has in the meantime approached entrance opening 20, the switch S1 will have opened and the elapsed delay time passed well before contacts LS2 open. Under this condition, then, relay R2 will be de-energized and contacts will be open prior to opening of contacts LS2. Thus, opening of contacts LS2 will de-energize relay M causing relay contacts M/1 to open and contacts M/2 also to revert to their closed condition. Under this condition, supply to winding **31*a* is still maintained, despite the opening of contacts M/1, because of the aforedescribed closure of contacts LS1/2 and R4/1. However, pursuant to the closing of contacts M/2 power is applied to winding 31*b* via contacts M/2, a rectifier 84 and a variable resistor 86. The rectifier 84 is partly by-passed by a parallel resistor 88, but the value of this is such that voltage applied to winding 31*b* is rectified by recitifer 84. The resultant rectified current flow through winding 71*b* causes motor 31 to operate at low speed so that as the 360 degrees extent of rotation is approached, the door 10** slows.

At the 360 degrees of rotation condition, cam 73 operates switch 77 to open contacts LS1/2 and LS1/1. Opening of contact LS1/1 causes immediate drop-out of relay R1 closing contacts R1/1. Relay R4, however, has a large value capacitor C3 connected thereacross and remains energized for a short period after contacts LS1/1 are open. Thus, despite the fact that contacts M/1 and LS1/2 are then open, supply to winding **31*a* is still maintained through the contacts R4/1. Contacts R4/2 are at this time also still closed by virtue of relay R4** still being energized.

At this time also, contacts R2/2 are closed, relay R2 having been de-energized as mentioned previously pursuant to lapse of the time provided by capacitor C1, and relay contacts R1/1 are again reverted to their closed condition pursuant to de-energization of relay R1. Thus contacts R4/2, R2/2, R1/1 are all closed and these are arranged to provide connection of a contactor C across supply for energization of this. Under this condition, then, contacts C/1 associated with contactor C are brought from an open to a closed condition at which they provide interconnection of both windings 31*a*, 31*b* of the motor 31 across supply. The motor is thus braked. The period of this braking is dependent on the timeout period of the relay R4 as provided by capacitor C3 but may be arranged to be of the order of one second. At the end of this time, contacts R4/1 are reverted to their open condition and contacts R4/2 are likewise brought to an open condition for de-energizing the contactor C. The circuit is thus brought back again to the condition of the various components as shown in the circuit diagram.

In the event that a further person should approach the entrance opening 20 such that relay R2 is re-energized to cause closing of contacts R2/1 at the time contacts LS2 are opened, relay M will remain energized and thus braking by closing of contacts M/2 will not occur. Similarly, the resultant opening of contacts R2/2 will prevent application of supply to contactor C and bringing into effect of the aforedescribed braking action which otherwise occurs pursuant to operation of the contactor. In this event, then, instead of the door 10 being brought back to its rest position, continuous operation through another cycle of operation as above described will occur. Thus a stream of people can pass through the doorway without interruption, by continuous operation of the door.

In the event that mat switch 32 is operated, the clutch 51 is operated to prevent rotation of the door in the following manner. Switch 32 is connected as shown so that when operated supply from rectifier 62 is applied to a further relay R3 via a resistor 90. Forthwith, contacts R3/1 associated with relay R3 are operated and these operate to apply supply directly to contactor C to close contacts C1 thereof thereby braking motor 31 to bring the door 10 to rest. At the same time, contacts R3/2 associated with relay R3 are closed for energizing a relay R5 connected via contacts R3/2 across terminals 1 and 2. Relay R5 is of the type which has a timed delay for operation thereof after application of supply thereto. Thus, its contacts R5/1 do not immediately close, but close after a short period. Closing of contacts R5/1 causes supply from rectifier 60 to be applied to the winding 51*a* of solenoid clutch 51 for locking of door 10. The delayed closing of contacts R3/2 is in order to enable the door to be brought to a standstill before clutch 51 is operated. If this were not the case, the strong action of the clutch may cause torsional stress in the door shaft 18 and possibly bend or otherwise damage this.

Pursuant to a person standing on mat 32, the door will remain locked for so long as relay R5 is energized. Relay R5 may be de-energized either by turning off supply from source S by opening switch CS whereupon relay R3 will be de-energized, after a time delay established by a capacitor C5 connected thereacross, whereupon opening of contacts R3/2 will occur to de-energize relay R5. Similarly, if a person once having caused operation of mat switch 32 by standing thereon, is able to withdraw away from the switch through the door exit opening 22, the switch 32 will be opened thus de-energizing relay R3 again after the time period determined by capacitor C5. In the absence, however, of operation of relay R3 in either manner, the door will remain locked to prevent persons passing through the door in the reverse direction.

The described arrangement has been advanced merely by way of explanation. For example, the door could be modified in many ways. Although an electromagnetic clutch is shown for the purpose of locking the door against movement in the reverse direction, other mechanisms may be employed. For example, a ratchet wheel could be connected to the shaft 18 with a solonoid actuated abutment member being provided operable of energization of relay R3 to cause the abutment to engage the periphery of the ratchet wheel so that rotation of the shaft 18 in the anti-clockwise direction as viewed in FIG. 2 was precluded to effect locking. Again, although a one-way bearing is shown for precluding rotation of the door in the clockwise direction as viewed in FIG. 2, other means such as a ratchet wheel and pawl mechanism could be employed for this purpose.

Further, whilst the described arrangement is a power actuated door in the sense that power assistance is provided to the door to turn it when a person approaches the door, it is not essential that the door be so constructed and an ordinary manually operated revolving door could be substituted. Whilst, in the described arrangement the motor 31, gear box 29, clutch 51 and cams 71, 73 and associated switches 75, 77 are all mounted above door 10, they could equally be mounted in the floor below door 10.

The described arrangement has been advanced merely by way of explanation and many modifications may be made thereto without departing from the spirit and scope of the invention as defined in the appended claims.

We claim:

1. The security door comprising:

(a) a revolving door assembly having an upright shaft and a plurality of outwardly extending upright door panels secured thereto, said door assembly being arranged for rotation about the axis of said shaft, (b) an enclosure extending around said revolving door assembly and presenting two opposed portions one to either lateral side of the revolving door assembly and each extending from an entrance to the security door to an exit thereof, the said opposed portions being so arranged that, as the said revolving door assembly revolves about said axis, there are always at least two said panels in position adjacent the upright inner surface of each respective said opposed portion to define a separate closed space between each respective opposed portion and the two adjacent said panels, whereby a person passing through the security door must move around said axis between an adjacent pair of said panels under rotation of the revolving door assembly, and through a said substantially closed space, (c) an electric motor, (d) a reduction gear drive coupled to said motor and to said shaft for driving of said shaft by operation of said motor through said reduction gear drive, (e) rotation controlling means permitting revolving of said revolving door assembly about said axis in one direction but precluding operation in the other direction, (f) a control circuit controlling operation of said motor for effecting revolving of the revolving door assembly in said one direction, said control circuit having a detector for detecting the presence of a person at said entrance and operating, pursuant to said detecting, to then cause said operation of said motor to revolve said revolving door assembly in said one direction and to brake the motor at the end of one revolution to stop revolving of the revolving door assembly, (g) an electric clutch mechanism coupled to said shaft, (h) a mat switch positioned in said enclosure adjacent to one of said opposed portions, being that of said opposed portion which must be passed by a person attempting passing through the security door from said exit to said entrance when said revolving door assembly revolves in said one direction, said mat switch being located such that it must be stepped on by such person attempting passing; said clutch mechanism and said mat switch being interconnected with said control circuit whereby said clutch mechanism is energized under control of the control circuit to lock said shaft against rotation thereof when a person steps on said mat switch whereby in use a person so stepping on the mat switch is trapped in the said substantially closed space then defined adjacent to the said one opposed portion.

2. A security door as claimed in claim 1, wherein said rotation controlling means is a one-way bearing receiving said shaft and arranged to prevent revolving of the shaft against said one direction.

3. A security door as claimed in claim 1, wherein said control circuit operates, after said mat switch is operated, to electrically brake said motor to at least substantially stop said revolving door assembly from revolving before said energization of said clutch mechanism takes place.

* * * * *